US008397940B2

(12) United States Patent
Steininger

(10) Patent No.: US 8,397,940 B2
(45) Date of Patent: Mar. 19, 2013

(54) FLUID DISPENSING VESSEL

(75) Inventor: Jeff Steininger, St. Marys, OH (US)

(73) Assignee: ZAK Designs, Inc., Spokane, WA (US)

( * ) Notice: Subject to any disclaimer, the term of this patent is extended or adjusted under 35 U.S.C. 154(b) by 272 days.

(21) Appl. No.: 12/924,691

(22) Filed: Sep. 30, 2010

(65) Prior Publication Data

US 2012/0080456 A1 Apr. 5, 2012

(51) Int. Cl.
*B65D 51/18* (2006.01)
*B65D 41/02* (2006.01)
*A47G 19/22* (2006.01)

(52) U.S. Cl. ..... 220/714; 220/254.1; 220/260; 220/703; 220/711; 220/713; 220/715; 222/531; 222/532

(58) Field of Classification Search ..... 220/254.1, 220/260, 262, 703, 711, 713, 714, 715; 222/531, 222/532
See application file for complete search history.

(56) References Cited

U.S. PATENT DOCUMENTS

| | | | | |
|---|---|---|---|---|
| 3,967,748 | A * | 7/1976 | Albert | 220/715 |
| 5,944,235 | A * | 8/1999 | Won | 222/506 |
| 6,116,476 | A * | 9/2000 | Huang | 222/506 |
| 2008/0272134 | A1 * | 11/2008 | Rohe | 220/713 |
| 2009/0250480 | A1 * | 10/2009 | Pinelli | 220/715 |

* cited by examiner

*Primary Examiner* — Anthony Stashick
*Assistant Examiner* — Madison L Poos
(74) *Attorney, Agent, or Firm* — Paine Hamblen, LLP

(57) ABSTRACT

A fluid dispensing vessel is described and which includes a container body for enclosing a fluid to be dispensed, and a removable lid having first and second portions which move one relative to the other, and wherein when the second portion of the lid is in a first position, fluid may not be dispensed from the container body, and when located in the second position, fluid may be dispensed from the container body, and wherein a latch is provided which releases the second portion of the removable lid from the first portion for travel to a second position to allow the dispensing of fluid.

17 Claims, 5 Drawing Sheets

FLUID DISPENSING VESSEL

TECHNICAL FIELD

The present invention relates generally to fluid dispensing vessels, and a mechanism for sealing and unsealing such vessels, and more particularly to an arrangement for opening and closing a drinking vessel with a single touch.

BACKGROUND OF THE INVENTION

Drinking containers of various types including travel mugs are well known in the art. Such drinking vessels have been designed for various purposes such as to be used on bicycles, while hiking, and doing various indoor and outdoor activities. In this art field much effort has been undertaken to design various removable lids, closure devices, or other mechanisms for opening and closing a drinking orifice of a drinking container in a convenient manner and to prohibit the spilling of the drink contained within the drinking vessel should it be accidently overturned. One example of a drinking vessel of this type is exemplified by U.S. Pat. No. 7,546,933, the subject matter of which is incorporated by reference herein. In this particular piece of prior art, the drinking vessel has a container body and a removable lid which covers the cavity of the drinking container, and which further has a trigger mechanism which operates various apertures in the lid so as to conveniently dispense the drink to the user thereof.

While the aforementioned US Patent, and others have operated with various degrees of success, there are shortcomings with such designs which have prohibited their commercial implementation. For example, in the prior art device noted above, the prior art product, when delivered, is readily operable to open and close a drink orifice with a single touch. However, a thorough review of the patent will reveal that the mechanism is quite complex in its overall design. Further, because of its complexity, and the fact that most of the mechanism is enclosed within the removable cover, such components inevitably become exposed to various different drinks which might be consumed by the user. For example, these drinking vessels may routinely be used to carry hot beverages, such as coffee. However, on occasion, such vessels may also be used for soft drink beverages, and even alcoholic beverages such as wine. When the internal components of these removable lids are exposed to such diverse fluids, often trace amounts of the fluid becomes deposited on these components. Later, when the liquid portion evaporates, it leaves behind a sticky residue or other deposit which will eventually cause the mechanism to malfunction. Further, such deposits within the removable caps also creates an unsanitary condition which, before long, will make the drinking vessel unsafe to use.

Therefore, it has long been known that it would be desirable to have a fluid dispensing vessel which can be opened and closed by a single touch, and which is easy to maintain, sanitary, and provides numerous benefits not achievable with the prior art devices known heretofore.

SUMMARY OF THE INVENTION

The present invention relates to a fluid dispensing vessel which includes a container body for enclosing a fluid to be dispensed, and wherein the container has a top dispensing opening, and a longitudinal axis; and a removable lid having a first portion which sealably cooperates with the top dispensing opening of the container body, and a second portion which moveably cooperates with the first portion and which is reciprocally, longitudinally moveable relative to the first portion, and the container body, between a first position, where the second portion of the removable lid occludes the top dispensing opening, and a second position, where the top dispensing opening is not totally occluded and fluid may be dispensed from the container body.

Still further, the present invention relates to a fluid dispensing vessel which includes a container body defining an internal cavity for enclosing a source of a fluid to be dispensed, and a top dispensing opening through which the source of fluid passes to be received in, and pass out of the internal cavity; a removable lid for selectively occluding the top dispensing opening of the container body, and wherein the removable lid defines, at least in part, a fluid dispensing opening, and wherein the removable lid is moveable along a predetermined linear path of travel between a first position, which prohibits fluid flow from the internal cavity of the container body, and a second position, which permits fluid flow from the container body; and a spring biased latch which is moveably borne by the removable lid, and which further retains the removable lid in the first position, and which, when forcibly engaged, permits the removable lid to move from the first position, to the second position.

Moreover, the present invention relates to a fluid dispensing vessel which includes a container body defined by a sidewall, a bottom surface coupled to the sidewall, and which further has a longitudinal axis, and wherein the container body has a top peripheral edge defining a dispensing opening, and wherein the sidewall of the container body further defines an internal cavity for enclosing a source of liquid to be dispensed to a user; a first portion of a removable lid which releasably engages the sidewall of the container body, and at least partially occludes the dispensing opening thereof, and wherein the first portion has a main body which is defined, at least in part, by a top surface which has a peripheral edge, and wherein a continuous sidewall having inwardly and outwardly facing surfaces depends downwardly from the peripheral edge, and wherein the inwardly facing surface of the continuous sidewall further defines an internal cavity which is sized so as to telescopingly receive, at least in part, and sealably cooperates with the top peripheral edge of the container body, and wherein the outside facing surface of the continuous sidewall defines a recessed channel having a given length dimension, and which has a proximal and a distal end, and wherein the top surface of the first portion of the removable lid further has a first spring seat which is defined by a continuous sidewall forming a cavity, and wherein the continuous sidewall of the first spring seat extends normally upwardly relative to the top surface of the first portion, and wherein the continuous sidewall of the first spring seat has a first engagement aperture formed therein, and which extends therethrough, and wherein the top surface further has a first passageway which extends normally, upwardly, relative thereto, and wherein the first passageway is defined by a continuous sidewall which has a proximal end mounted on the top surface of the first portion, and an opposite, distal end, and wherein the sidewall defining the first passageway is coaxially oriented relative to a valve seat which is formed in the top surface of the first portion, and wherein the valve seat couples the first passageway in fluid flowing relation relative to internal cavity of the container body; a second portion of the removable lid which is reciprocally longitudinally moveable relative to both the first portion of the removable lid, and the container body, and wherein the second portion of the removable lid has a main body defined by a top surface, and which has inwardly and outwardly facing surfaces, and a peripheral edge, and wherein a circumscribing sidewall extends downwardly relative to the peripheral edge of the main body, and which also has inwardly and outwardly facing surfaces, and wherein the top surface of the second portion defines a fluid dispensing aperture which extends therethrough, and which is oriented in fluid flowing communication with the distal end of the first passageway as defined by the first portion of the removable lid, and wherein the inside facing surface of the circumscribing sidewall of the second portion defines an internal cavity which is sized so as to telescopingly receive the first portion of the removable lid, and to facilitate, at least in part, the reciprocal longitudinal movement of the second portion relative to the first portion, and wherein the inside facing surface of the continuous sidewall of the second portion further includes a protrusion which is matingly received within the recessed channel defined by the first portion, and which is operable to limit the reciprocal movement of the second portion relative to the first portion, and wherein a latch aperture is formed in the continuous sidewall of the second portion, and wherein a valve member is mounted on the inside facing surface of the top surface of the second portion, and is coaxially aligned relative to the first passageway as defined by the first portion of the removable lid, and wherein the valve member has a distal end which sealably mates with the valve seat, as defined by the first portion, when the second portion of the removable lid is located in a first position, so as to prohibit the flow of the source of fluid from the container body, and is displaced from the valve seat when the second portion of the removable lid is located in a second position, so as to facilitate the flow of the source of fluid from the container body, through the first passageway, and out of the fluid dispensing aperture formed in the top surface of the second portion, and wherein a second spring seat is defined by a continuous sidewall which depends downwardly relative to the inside facing surface of top surface of the second portion, and wherein the continuous sidewall of the second spring seat has inside and outside facing surfaces, and wherein the inside facing surface thereof defines a cavity which is coaxially aligned relative to the first spring seat, and is sized so that the first spring seat may be telescopingly received within the cavity as defined by the second spring seat, and wherein the continuous sidewall defining the second spring seat has a second engagement aperture formed therein, and wherein, when the second portion of the removable lid is in the first position, the first and second engagement apertures are coaxially aligned, and wherein the outside facing surface of the continuous sidewall forming the second spring seat has a latch guiding channel formed therein; a first biasing spring positioned between the first and second portions of the removable lid, and located in the cavities defined by the first and second spring seats, and wherein the first biasing spring exerts a first biasing force which causes the second portion of the removable lid to be urged in the direction of the second position, and which is coaxially oriented relative to the longitudinal axis of the container body; a moveable latch borne by the second portion of the removable lid, and which releasably secures the second portion of the removable lid in the first position against the first biasing force as exerted by the first biasing spring, and wherein the latch has a main body with a first, proximal end, which extends radially, outwardly, relative to the second portion of the removable lid, and out through the latch aperture formed in second portion; a second, distal end, which mounts an inwardly facing engagement portion which is slideably received within, and extends through, the second engagement aperture as defined by the second spring seat; and an intermediate portion which extends between the first and second ends, and wherein the intermediate portion of the latch defines an aperture which is sized so as to receive the second spring seat therein, and wherein the intermediate portion of the latch is slideably received in the latch guiding channel which is formed in the second spring seat; and a second biasing spring is located between the outside facing surface of the continuous sidewall defining the second spring seat, and the first end of the latch, and wherein the second biasing spring is located, at least in part, within the aperture as defined by the intermediate portion of the main body of the latch, and wherein the second biasing spring exerts a second biasing force which is perpendicular to the first biasing force, and further causes the first end of the latch to be urged radially, outwardly, relative to the second portion of the removable lid, and wherein when the first portion of the removable lid is located in the first position, the engagement portion of the latch extends through the coaxially aligned first and second engagement apertures as formed in the first and second spring seats so as to retain the second portion in the first position against the first biasing force generated by the first biasing spring, and wherein in the first position, no liquid can be dispensed from the container body, and wherein when a user exerts force on the first end of the latch to move it radially inwardly relative to the second portion of the removable lid, the engagement member is moved out of the first engagement aperture as defined by the first spring seat, and the first biasing spring is then effective in moving the second portion of the removable lid from the first position to the second position so as to facilitate the dispensing of the source of fluid out through the fluid dispensing opening as formed in the second portion of the removable lid.

These and other aspects of the present invention will be described in greater detail hereinafter.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
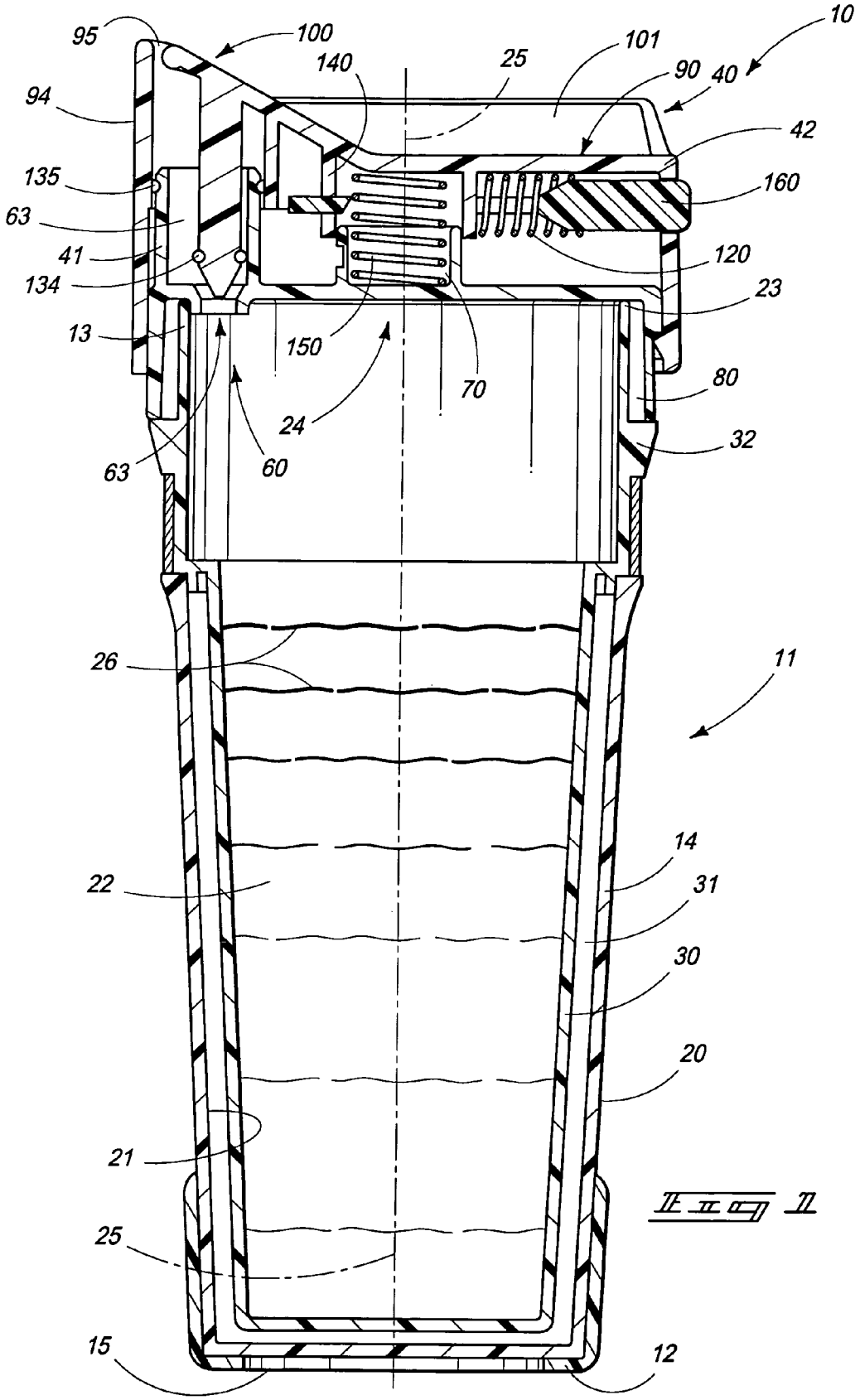
FIG. 1 is a transverse, longitudinal sectional view taken through the fluid dispensing vessel of the present invention.
Figure 2:
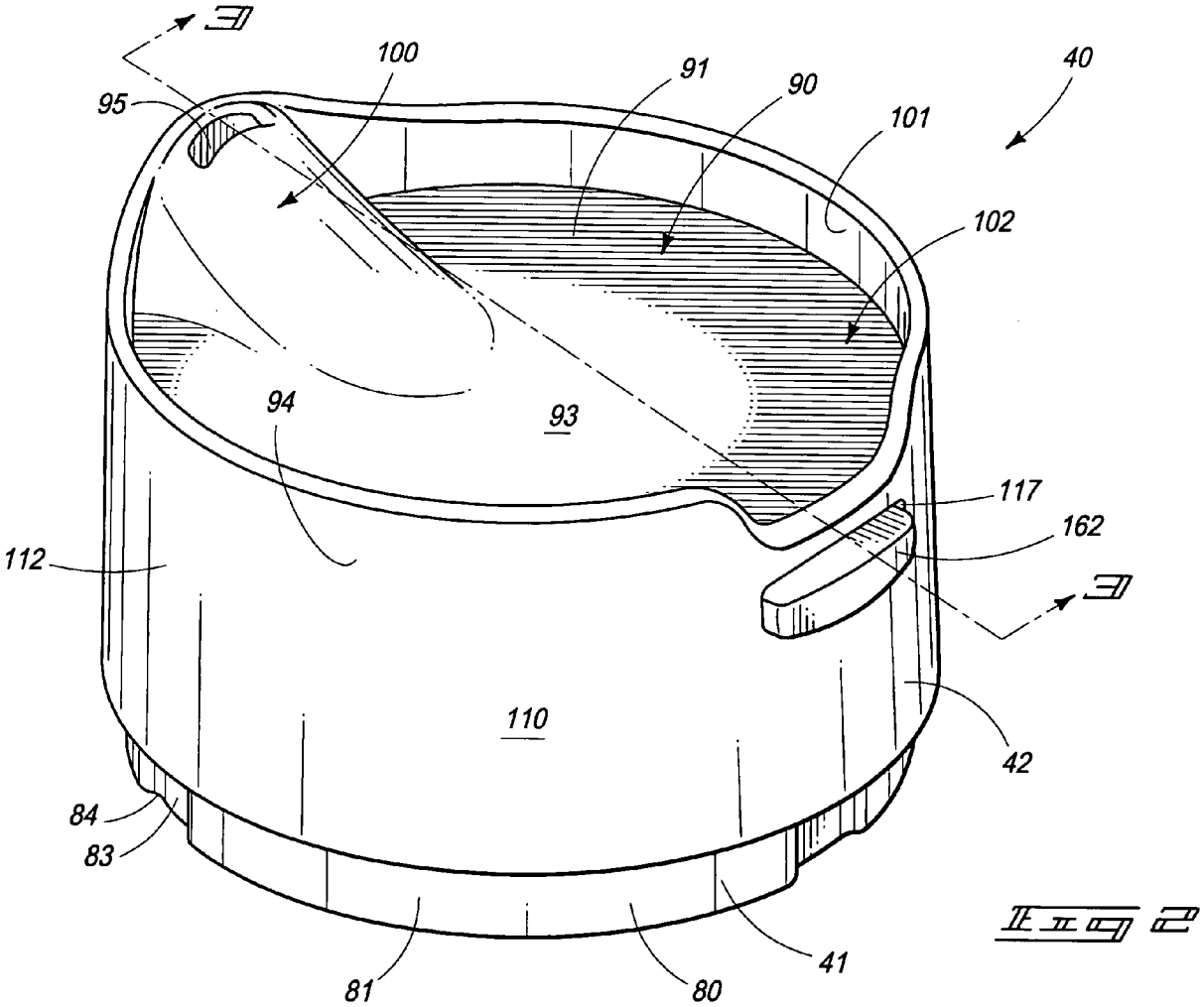
FIG. 2 is a perspective view of a removable lid which forms a feature of the present invention.

The present invention is best appreciated by the study of FIG. 1 and following. As seen therein, the fluid dispensing vessel 10 of the present invention generally includes a container body which is indicated by the numeral 11. The container body has a first end 12, and an opposite, second end 13. The container body 11 is further defined by a generally circular and continuous sidewall 14, and a bottom surface 15 is provided, and which is suitably coupled to the continuous sidewall 14 to form the resulting container body 11. As seen in FIG. 1, the sidewall 14 has an outside facing surface 20, and an inside facing surface 21. As will be appreciated by those skilled in the art, and as seen in the drawings, the outside facing surface 20 of the sidewall 14, in the region of the second end 13, provides a smooth circumscribing surface with which a removable lid may releasably, sealably engage. While the present drawings show this outside facing surface 20 as being substantially smooth, those skilled in the art will recognize that this outside facing surface may be formed with conventional screw threads or other conventional means (not shown) by which an accompanying removable lid may be releasably secured in a convenient manner to the second end of the container body 11. The removable lid, which forms a feature of the present invention, will be discussed in greater detail, hereinafter. The inside facing surface 21, of the sidewall 14, defines an internal cavity 22 of given dimensions. Still further, the sidewall 14 at the second end 13, of the container body 11, defines a peripheral edge 23. This peripheral edge 23 further defines a dispensing opening 24. Furthermore, the container body 11 is defined by a longitudinal axis which is generally indicated by the line labeled 25. It should be understood that the internal cavity 22 is operable to enclose a fluid, or liquid to be dispensed 26. This fluid or liquid to be dispensed moves into, and out of, the internal cavity 22 by means of the dispensing opening 24 in the manner which will be described in greater detail, hereinafter. As seen in FIG. 2, and in one possible form of the invention, the internal cavity 22 includes a second internal sidewall 30 as is well known in the fashion of a thermal insulating container. The second internal sidewall 30 is positioned in spaced relationship from the inside facing surface 21, and a gap 31 is defined therebetween the inside facing surface 21 and the second internal sidewall 30. Still further, and as seen in the drawings, the container body 11 includes a circumscribing and circumferentially enlarged abutment 32 which is spaced from the second end 13, and which provides a convenient visual means for indicating to the user of the vessel 10 that the removable lid (as will be described below) is fully seated and positioned in a correct sealably occluding relationship relative to the dispensing opening 24 of the container body 11.

Figure 5:
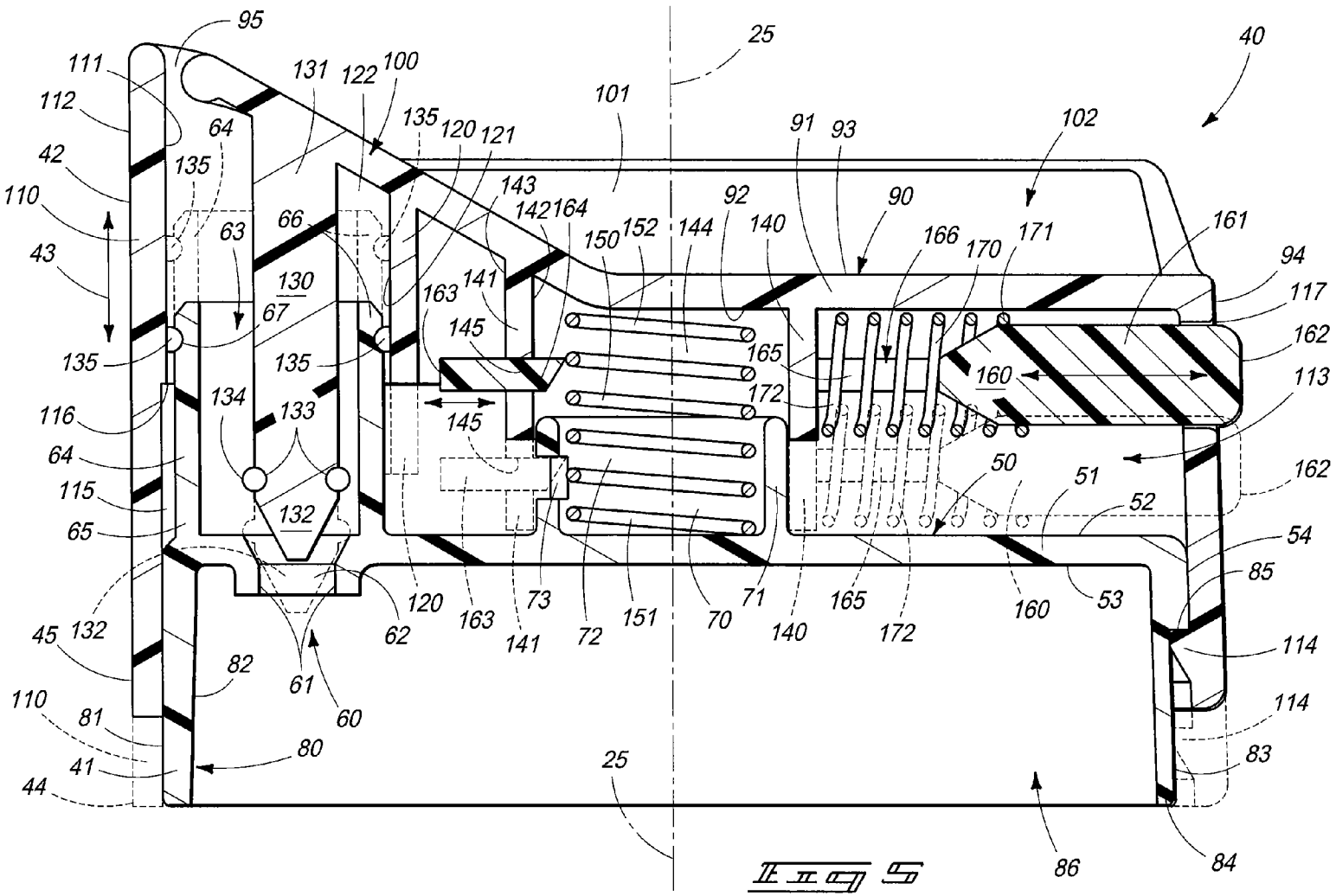
FIG. 5 is a greatly enlarged longitudinal, sectional view which is taken from a position along line 3-3 of FIG. 2, and of a removable lid forming a feature of the present invention, and which shows the movement of the removable lid by means of phantom lines.

Referring now to FIG. 2, and following, and as seen more specifically in FIG. 5, the fluid dispensing vessel 10 of the present invention includes a removable lid which is generally indicated by the numeral 40, and which further includes a first portion 41 which sealably cooperates with the top dispensing opening 24 of the container body 11. Additionally, the removable lid 40 has a second portion 42 which movably cooperates with the first portion 41, and is further reciprocally, longitudinally moveable along a path of travel 43 relative to the first portion 41, and the container body 11, between a first position 44, where the second portion 42 of the removable lid 40 occludes the top dispensing opening 24, and a second position 45, where the top dispensing opening 24 is at least partially non-occluded, and the fluid or other drink 26 may be dispensed such as by drinking or pouring from the container body 11.

Figure 3:
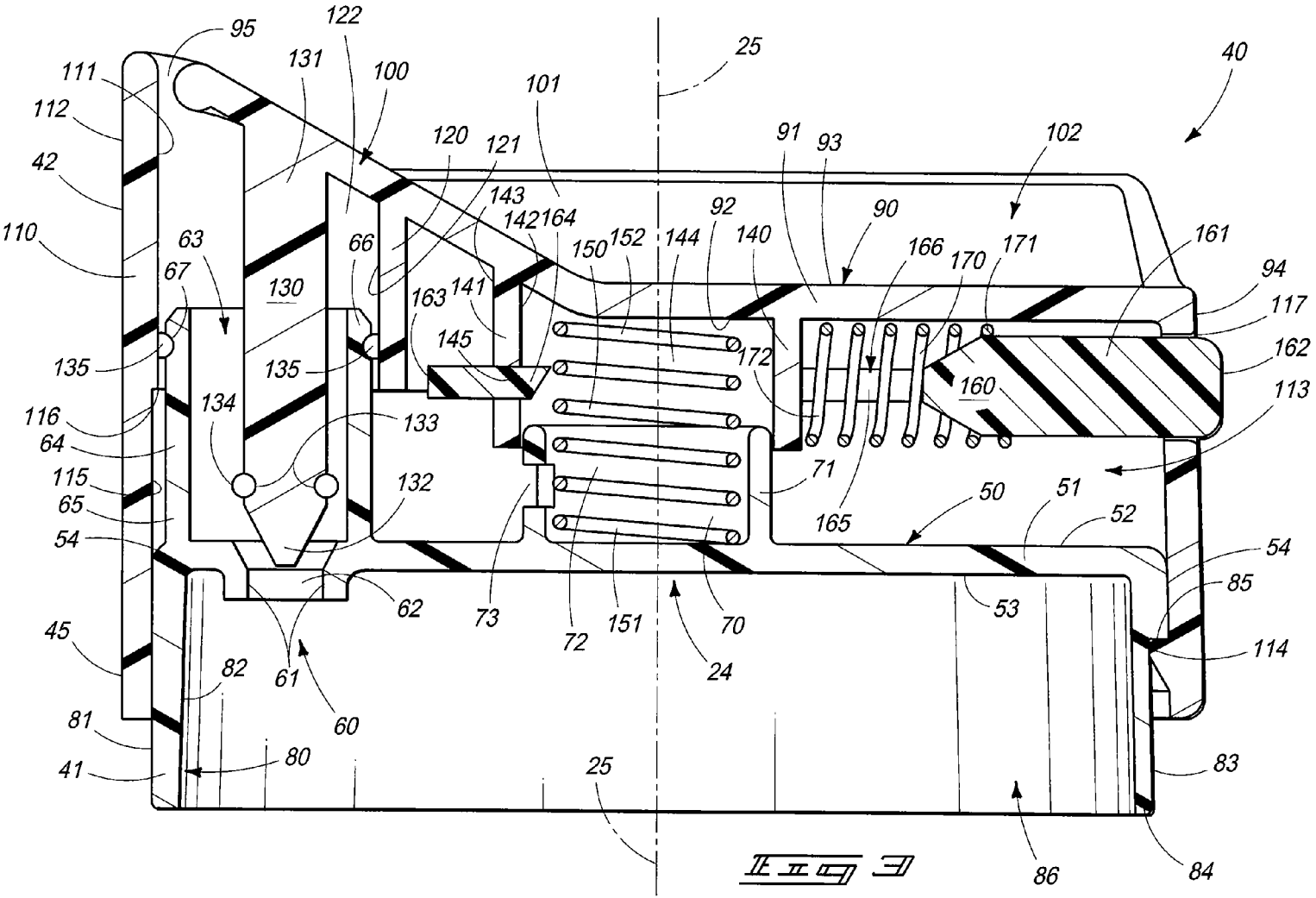
FIG. 3 is a greatly enlarged longitudinal, sectional view which is taken from a position along line 3-3 of FIG. 2, and through a removable lid which forms a feature of the present invention.
Figure 4:
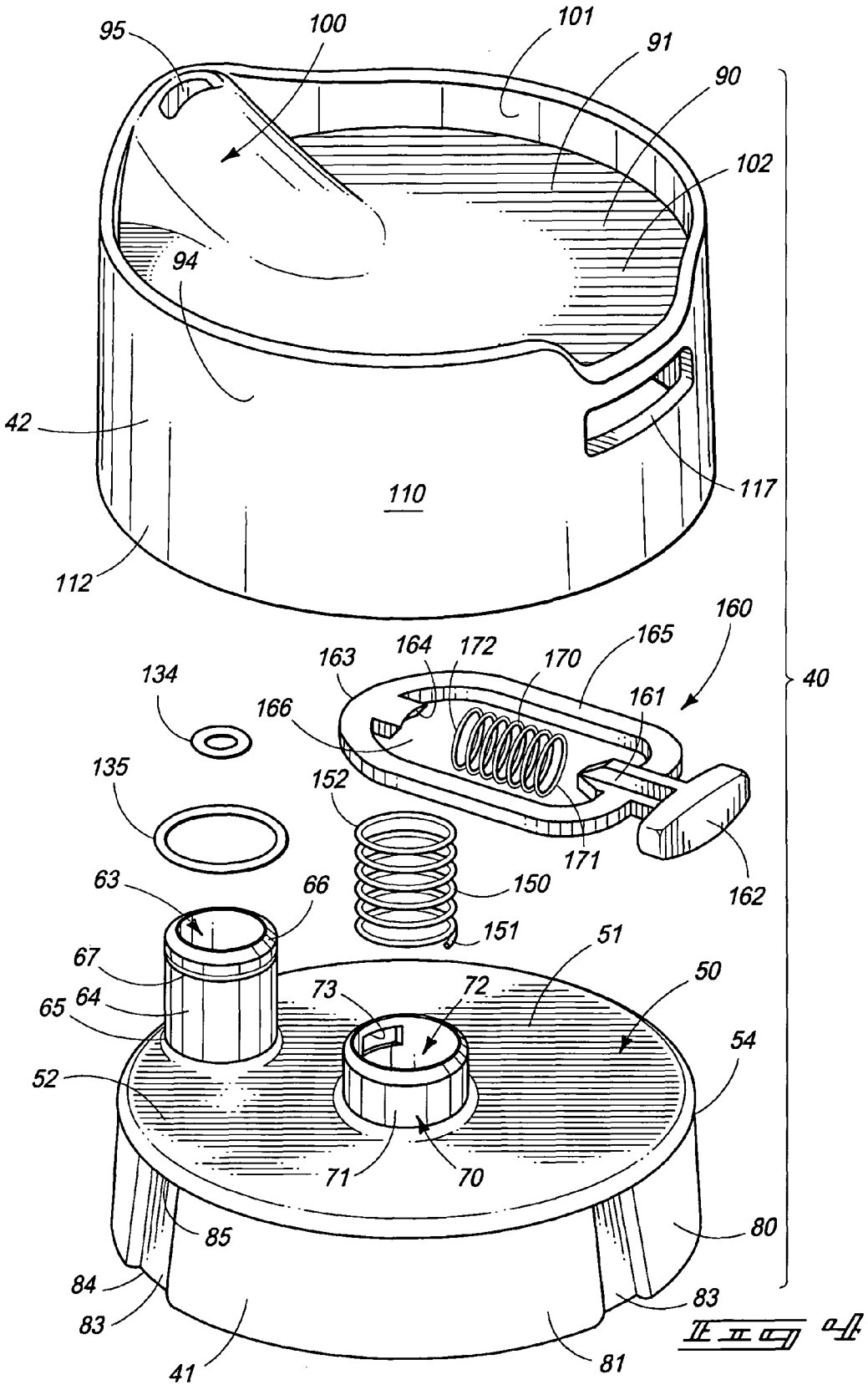
FIG. 4 is an exploded, perspective view of a removable lid which forms a feature of the present invention.

Referring now to FIGS. 3-5, it will be seen that the first portion 41 of the removable lid 40 is defined by a main body 50, having a top surface 51. The top surface 51 has an outside facing surface 52, and an opposite inside facing surface 53. The top surface 51 of the main body 50 has a peripheral edge which is generally indicated by the numeral 54. As seen in FIG. 3, and following, a valve seat that is generally indicated by the numeral 60 is formed in the top surface 51, and extends therethrough. The valve seat 60 is defined by a continuous, substantially circular sidewall 61. The sidewall 61 defines a valve aperture 62, which allows fluid 26 to pass from the container body 11 therethrough. Still further, extending normally upwardly relative to the top surface 51 is a first passageway 63. The first passageway 63 is substantially coaxially aligned relative to the valve seat 60, and the valve aperture 62. The first passageway 63 is defined by a continuous substantially cylindrical sidewall 64. The continuous sidewall 64 has a first, or proximal end 65, which is affixed to the top surface 51 of the first portion 41, and an opposite, distal end 66. As seen most clearly by reference to FIG. 3, a gasket seat 67 is formed in close proximity to the distal end 66, and is operable to receive a gasket or O-ring like seal which will be described in greater detail hereinafter. As seen in FIG. 3, and following, and spaced from the first passageway 63, and further extending normally, upwardly, relative to the top surface 51, is a first spring seat which is generally indicated by the numeral 70. The first spring seat is defined by a continuous cylindrical sidewall that is generally indicated by the numeral 71. The continuous sidewall 71 further defines an internal cavity 72 which is sized so as to receive a first biasing spring which will be discussed in greater detail hereinafter. Additionally, as seen in FIG. 3, and following, a first engagement aperture 73 is formed in a predetermined location in the sidewall 71, and is operable to receive and moveably cooperate with an engagement member which will also be discussed in greater detail, hereinafter.

As seen in FIG. 3 and following, the first portion 41 of the removable lid 40 includes a continuous, circular, and depending sidewall 80 which extends downwardly from the peripheral edge 54 of the top surface 51. As seen in the drawings, the depending sidewall has an outside facing surface 81, and an opposite, inside facing surface 82. As illustrated, the outside facing surface 81 has formed therein at least one recessed channel 83 which has a proximal end 84, and an opposite, distal end 85. The operation of this recessed channel will be discussed in greater detail, hereinafter. Still further, the inside facing surface 82 defines a internal cavity 86, and which is sized so as to telescopingly receive the second end 13 of the container body 11 as seen in FIG. 1. As should be appreciated, the inside facing surface 82 is illustrated here as having a smooth surface so that it may releasably and fluid sealably couple on, and about, the outside facing surface 20, of the container body 11, in the nature of a friction-fit. On the other hand, those skilled in the art will recognize that the inside facing surface 82 may be formed with complimentary threads and other mechanical arrangements so that the first portion 41 may easily, releasably, and sealably couple to the container body 11 in a fashion which will allow the first portion to be conveniently released from the container body so as to permit a user (not shown) to replenish or refill the fluid 26 to the internal cavity 22 thereof. As seen in FIG. 3, and following, the valve aperture 62 couples the first passageway 63 in fluid flowing relation relative to the internal cavity 86 as defined by the depending sidewall 80.

Referring still to FIGS. 3-5, it will be seen that the removable lid 40, and more specifically the second portion 42 thereof, is reciprocally, longitudinally movable relative to both the first portion 41 of the removable lid 40, and the container body 11. In this regard, the second portion 42, of the removable lid 40, has a main body 90 which is defined by a top surface 91, and which further has inwardly and outwardly facing surfaces 92 and 93, respectively. Still further, the top surface 91 has a peripheral edge 94, and a fluid dispensing aperture 95 is formed in the top surface 91, and which extends therethrough, and which is oriented in fluid flowing communication with the distal end 66, of the first passageway 63, as defined by the first portion 41, of the removable lid 40. As will be discussed in greater detail hereinafter, when the second portion 42 of the removable lid is located in the second position 45, (FIG. 5) fluid or other drink 26 contained within the container body 11 may escape through the first passageway 63, and through the fluid dispensing aperture 95, so as to be consumed or used by a user (not shown). Further, when the second portion 42 is located in the first position 44 (phantom lines in FIG. 5), no fluid may be dispensed from the container body 11 as will be discussed in greater detail, below.

As best seen in FIG. 2, for example, it will be recognized that the second portion 42 of the removable lid includes a drinking spout portion 100 which forms an integral part of the top surface 91 thereof. As will be seen in this view, the fluid dispensing aperture 95 is formed in the drinking spout portion 100, and provides a convenient means for dispensing fluids, or other drinks 26, from the container body 11 when the second portion 42 of the removable lid is located in the second position 45 as will be discussed below. Still further, it will be seen from FIG. 2, for example, that the second portion 42 includes an upwardly projecting sidewall 101 which extends substantially around the peripheral edge 94, and in an upward direction so as to confine or otherwise retain fluid or other liquid which comes out of the spout 95 by accident, or by the user's use of the fluid dispensing vessel 10. This upwardly extending sidewall 101 defines a top cavity 102 for retaining this drink or other fluid. As also seen the drawings (FIG. 3), the second portion 42 includes a circumscribing sidewall 110 which extends downwardly relative to the peripheral edge 94 of the main body 90. This downwardly depending, and circular shaped sidewall 110, has inwardly and outwardly facing surfaces 111 and 112, respectively. The inwardly facing surface 111 of the circumscribing sidewall 110 defines an internal cavity 113 which is sized so as to telescopingly receive the first portion 41 of the removable lid 40, and which facilitates, at least in part, the reciprocal longitudinal movement of the second portion 42 relative to the first portion 41. The inside facing surface 111 of the continuous sidewall 110 further includes a protrusion 114 which is matingly received within the recessed channel 83 that is defined by the first portion 41, and which is operable to limit the outwardly, longitudinal, and reciprocal movement of the second portion 42 relative to the first portion 41, when the protrusion 114 engages the distal end 85 of the recessed channel 83 as best seen in FIG. 3. Still further, as will be seen in the drawings, a recessed channel 115 is formed in the inwardly facing surface 111, of the downwardly depending sidewall 110. This recessed channel 115 cooperates with the first portion 41 so as to limit the inwardly directed longitudinal and reciprocal motion of the second portion 42 relative to the first portion 41. The operation of the first and second portions 41 and 42 will be discussed in greater detail below. This restraint of the inwardly longitudinally directed motion of the second portion 42 relative to the first portion 41 is caused by the engagement of the distal end 116 of the recessed channel 115 with the peripheral edge 54 as best seen by reference to FIG. 5. Additionally, it will be seen in the drawings (FIGS. 2 and 4), that a latch aperture 117 is formed in the continuous depending sidewall 110 of the second portion 42 and which will accommodate a latch which will be discussed in greater detail, hereinafter.

Referring again to FIGS. 3-5, it will be seen that a second depending sidewall 120 extends downwardly from the inwardly facing surface 92 of the main body 90, and is located closely adjacent to the fluid dispensing aperture 95 thereof. This secondary, depending sidewall 120 has an inside facing surface 121, which defines a passageway 122, and which is sized so as to be slightly greater than the cross-sectional dimension of the continuous sidewalls 64 forming the first passageway 63. In this arrangement, the first passageway 63 can be coaxially telescopingly received within the passageway 122, when the second portion 42 is located in the first position 44 (see FIG. 5). It will be seen by studying these drawings that an elongated valve member 130 extends downwardly relative to the inwardly facing surface 92 of the main body 90 and centrally within the passageway 122. This valve member 130 is oriented in a substantially coaxially aligned orientation or relationship relative to the valve aperture 62, as defined by the valve seat 60. The valve member 130 has a proximal end 131 which is mounted to the inwardly facing surface 92 of the main body 90, and an opposite, distal end 132, which is substantially frusto-conically shaped, and which is operable to be received in an occluding relationship relative the valve aperture 62, and engage the sidewall 61 thereof in a fluid sealing orientation when the second portion 42 of the removable lid is located in the first position 44 (FIG. 5). In this regard, it will be seen that a circumscribing seat 133 for a seal 134 is formed in close proximity to the distal end 132 of the valve member 130. Further, a first fluid impervious seal, such as a synthetic O-ring 134 is received in the circumscribing seal seat 133. Additionally, a second fluid impervious seal, or O-ring 135, is borne by the first passageway 63, and is received in the gasket seal seat 67, as formed near the distal end 66 of the continuous sidewall 64. The second fluid impervious seal 135 is operable to sealably mate in fluid sealing relation thereagainst the inside facing surface 121 of the depending sidewall 120. This seal prevents fluid that has been previously drained or removed from the container body 11 from traveling into the cap assembly and leaking therefrom. The second fluid impervious seal 135 further allows the second portion 42 of the removable lid to move along the course of travel 43 between the closed and open positions 44 and 45 respectively (FIG. 5).

Therefore, it will be understood that the valve member 130 has a distal end 132 which sealably mates with the valve seat 62 as defined by the first portion 41 when the second portion 42 of the removable lid 40 is located in a first position 44. This prohibits the flow of the source of fluid 26 from the container body 11. Still further, when the valve member 130 is displaced from the valve seat 60, as when the second portion 42 of the removable lid 40 is located in a second position 45, this facilitates the flow of the source of fluid 26 from the container body 11 through the first passageway 63 (FIG. 3).

Referring still to FIGS. 3-5, it will be seen that a second spring seat 140 is mounted on, and extends downwardly from the inwardly facing surface 92 of the second portion 42. The second spring seat 140 is defined by a continuous sidewall which is generally indicated by the numeral 141. The continuous sidewall 141 has an inside facing surface 142, and an outside facing surface 143. The inside facing surface 142 defines a cavity 144 which is substantially coaxially aligned relative to the first spring seat 70, and is further sized so that the first spring seat 70 may be slideably, and telescopingly received within the cavity 144 as defined by the second spring seat 140. The continuous sidewall 141 defining the second spring seat 140 has a second engagement aperture 145 formed in a predetermined position therein such that when the second portion 42 of the removable lid 40 is located in the first position 44, the first and second engagement apertures 73 and 145 are substantially coaxially aligned (FIG. 5). Still further, it will be understood by a study of FIGS. 3-5 that the outside facing surface 143 of the second spring seat 140 has formed therein a latch guiding channel (not shown) for locating or otherwise orienting or slideably supporting the latch in a given spaced, slideable position or orientation relative to the removable lid 40.

As seen in the drawings, a first biasing spring 150 is positioned between the first and second portions 41 and 42 of the removable lid 40, and located in the first and second spring seats 70 and 140, respectively. The first biasing spring 150 has a first end 151 which is received in the cavity 72; and an opposite, second end 152 which is received in the cavity 144. The first biasing spring 150 exerts a first biasing force which is coaxially aligned relative to the longitudinal axis 25 of the container 11, and which causes the second portion 42 of the removable lid 40 to be urged in a longitudinally outward direction and towards the second position 45. This is seen most clearly by reference to FIG. 5.

As further seen in the drawings, and specifically in FIG. 4, a moveable latch which is generally indicated by the numeral 160 is borne by the second portion 42, of the removable lid 40, and is located in spaced relation relative to the inwardly facing surface 92 of the second portion 42 (FIG. 5). The latch 160 releasably secures the second portion 42, of the removable lid 40, in the first position 44 (FIG. 5 in phantom lines) against the first biasing force as exerted by the first biasing spring 150. In this regard, the latch 160 has a main body 161, with a first, or proximal end 162, which extends radially outwardly relative to the second portion 42, of the removable lid 40 (FIG. 2), and out through the latch aperture 117 formed in the second portion 42. Still further, the latch 160 has a second, or distal end 163, which mounts an inwardly facing engagement portion 164 which is slideably received within, and extends through, the second engagement aperture 145 as defined by the second spring seat 140. Additionally, the moveable latch 160 includes an intermediate portion 165 which extends between the first and second ends 162 and 163. The intermediate portion 165 of the latch 160 defines an aperture 166 which is sized so as to receive the second spring seat 140 therein (FIG. 4). The intermediate portion 165 of the latch 160 is slideably received in the latch guiding channels which are formed in the second spring seat 140 (and which are not shown in the drawings).

As best seen by reference to FIG. 3 and following, the present invention 10 includes a, second biasing spring which is generally indicated, by the numeral 170. The second biasing spring has opposite ends 171 and 172, respectively. The second biasing spring is oriented between the outside facing surface 143 of the continuous sidewall 141, of the second spring seat 140, and the first end 162 of the moveable latch 160 (FIGS. 4 and 5). The second biasing spring 140 is located, at least in part, within the aperture 166 as defined by the intermediate portion 165 of the main body 161 of the latch 160. The second biasing spring exerts a second biasing force which is substantially perpendicular relative to the first biasing force as provided by the first biasing spring 150. As earlier noted, the first biasing spring exerts a first biasing force which is substantially coaxially aligned relative to the longitudinal axis 25 as defined by the container 11. The second biasing spring exerts the second biasing force in a manner which causes the first end 162 of the latch 160 to be urged radially outwardly relative to the second portion 42 of the removable lid 40. In the arrangement as seen in the drawings, it will be understood that when the first portion 41 of the removable lid 40 is located in the first position 44, the engagement portion 164 of the latch 160 extends through the coaxially aligned first and second engagement apertures 73 and 145, respectively, so as to retain the second portion 42 in the first position 44 against the first biasing force of the first biasing spring 150. Still further, and as earlier discussed, it should be appreciated that when the second portion 42 is located in the first position 44, no liquid can be dispensed from the container body 11. Further, when a user (not shown) exerts force (a single touch) on the first end 162 of the latch 160 to cause it to move radially inwardly relative to the second portion 42 of the removable lid 40, the engagement member 164 is moved out of the first engagement aperture 73 as defined by the first spring seat 70, and the first biasing spring 150 is then effective in moving the second portion 42 of the removable lid 40 longitudinally outwardly along the axis 25, from the first position 44, to the second position 45, so as to facilitate the dispensing of the source of fluid 26 out through the fluid dispensing opening 95 as formed in the second portion 42 of the removable lid 40.

Operation

The operation of the described embodiment of the present invention is believed to be readily apparent, and is briefly summarized at this point.

As seen in FIGS. 1-5, a fluid dispensing vessel 10 is shown, and which includes, in its broadest aspect, a container body 11 for enclosing a fluid to be dispensed 26, and wherein the container body has a top dispensing opening 24, and a longitudinal axis 25. The fluid dispensing vessel, as shown in the drawings, also includes a removable lid 40, having a first portion 41, which sealably cooperates with the top dispensing opening 24 of the container body 11. Still further, the removable lid includes a second portion 42, which moveably cooperates with the first portion 41, and which is reciprocally, longitudinally moveable relative to the first portion 41, and the container body 11. The second portion of the removable lid is operable to move between a first position 44, where the second portion 42 of the removable lid 40 occludes the top dispensing opening 24, and a second position 45, where the top dispensing opening 24 is non occluded, and fluid 26 may be dispensed from the container body 11. In the arrangement as seen in the drawings, the fluid dispensing vessel 10 of the present invention also includes a first biasing spring 150 which is located between the first and second portions 41 and 42 of the removable lid 40. The first biasing spring biases the second portion 42 of the removable lid 40 in a longitudinally coaxial direction 25 outwardly relative to the container body 11, and in the direction of the second position 45. As seen the attached drawings, the first portion 41 of the removable lid 40 is partially, telescopingly received within the second portion 42 of the removable lid 40. In addition to the foregoing, the first portion 41 of the removable lid 40 defines a first passageway 63, communicating with a valve seat 60, and which is coupled in fluid flowing relation relative to the container body 11. Still further, the second portion 42, of the removable lid 40, has a valve member 130 which is received, at least in part, within the first passageway 63, and which is sized so as to sealably cooperate and occlude the first passageway 63 when the second portion of the removable lid 40 is located in the first position 44. The present invention also includes a latch 160 which is moveably borne by the second portion 42 of the removable lid 40, and which releasably secures the second portion 42 of the removable lid 40 in the first position 44. The latch of the present invention 160 has a first end 162 which extends radially outwardly relative to the second portion 42 of the removable lid 40, and a second end 163, which has an engagement portion 164 which releasably engages the first portion 41 of the removable lid 40 to secure the second portion 42 of the removable lid in the first position 44. The invention also includes a second biasing spring 170 which is borne by the second portion 42 of the removable lid 40. The second biasing spring cooperates with the latch 160 so as to cause the latch 160 to be biased in a radially outward direction relative to the second portion of the removable lid 40. The latch 160 is also reciprocally movable along a path of travel which is substantially perpendicular relative to the longitudinal axis 25 of the container body 11. In the arrangement as seen in the drawings, the latch 160 has an intermediate portion 165 which is located between the first and second ends 162 and 163 thereof. The latch defines, at least in part, an aperture 166, and wherein the first biasing spring 150 extends through the aperture 166 defined by the intermediate portion 165 of the latch 160. A first biasing force generated by the first biasing spring 150 is substantially perpendicular to a second biasing force which is generated by the second biasing spring 170. As described earlier in the application, when a physical force of a given magnitude is applied by a user to the first end 162 of the latch 160 it overcomes the second biasing force as provided by the second biasing spring 170. Thereafter, this force causes the engagement portion 164 of the latch 160 to move out of engagement with the first portion 41 of the removable lid 40. When this event occurs, and following disengagement of the engagement portion 164 from the first portion 41 of the removable lid 40, the first biasing spring 150 moves the second portion 42 of the removable lid 40 from the first position 44, to the second position 45 (FIG. 5), under the influence of the biasing force provided by the first biasing spring 150. Still further, and as seen in the drawings, it will be understood that when a force is applied by a user in a direction along the longitudinal axis 25 of the container body 11, and in a direction toward the container body 11, that being, longitudinally inwardly, this same force overcomes the first biasing force generated by the first biasing spring 150. When this event occurs, the second portion 42 of the removable lid 40 moves from the second position 45, to the first position 44. When received in the first position 44, the second biasing spring 170 causes the engagement portion 164 of the latch 160 to move into cooperative engagement with the first portion 41 of the removable lid 140 so as to releasably secure the second portion of the removable lid in the first position. As earlier discussed, when the second portion 42 of the removable lid is in the first position, no fluid 26 may be dispensed from the container body 11.

Therefore, it will be seen that the present invention provides a convenient means whereby a user with a single touch can dispense a fluid or drink conveniently from the drink container 11 in a manner not possible heretofore.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A fluid dispensing vessel, comprising:

a container body for enclosing a fluid to be dispensed, and wherein the container has a top dispensing opening, and a longitudinal axis; and a removable lid having a first portion which sealably cooperates with the top dispensing opening of the container body, and a second portion which moveably cooperates with the first portion and which is reciprocally, longitudinally moveable relative to the first portion, and the container body, between a first position, where the second portion of the removable lid occludes the top dispensing opening, and a second position, where the top dispensing opening is non occluded and fluid may be dispensed from the container body, and wherein the first portion of the removable lid is at least partially, telescopingly received within the second portion of the removable lid.

2. A fluid dispensing vessel as claimed in claim 1, and further comprising:

a first biasing spring located between the first and second portions of the removable lid, and which biases the second portion of the removable lid in a longitudinally coaxial direction outwardly relative to the container body, and in the direction of the second position.

3. A fluid dispensing vessel as claimed in claim 2, and wherein the first portion of the removable lid defines a first passageway, having a valve seat, and which is coupled in fluid flowing relation relative to the container body, and wherein the second portion of the removable lid has a valve member which is received, at least in part, within the first passageway, and which is sized so as to sealably cooperate and occlude the first passageway when the second portion of the removable lid is located in the first position.

4. A fluid dispensing vessel comprising:

a container body for enclosing a fluid to be dispensed, and wherein the container has a top dispensing opening, and a longitudinal axis;

a removable lid having a first portion which sealably cooperates with the top dispensing opening of the container body, and a second portion which moveably cooperates with the first portion and which is reciprocally, longitudinally moveable relative to the first portion, and the container body, between a first position, where the second portion of the removable lid occludes the top dispensing opening, and a second position, where the top dispensing opening is non occluded and fluid may be dispensed from the container body; and a latch moveably borne by the second portion of the removable lid, and which releasably secures the second portion of the removable lid in the first position, and wherein the latch has a first end which extends radially outwardly relative to the second portion of the removable lid, and a second end which has an engagement portion which releasably engages the first portion of the removable lid to secure the second portion of the removable lid in the first position.

5. A fluid dispensing vessel as claimed in claim 4, and further comprising:

a first biasing spring located between the first and second portions of the removable lid, and which biases the second portion of the removable lid in a longitudinally coaxial direction outwardly relative to the container body, and in the direction of the second position; and a second biasing spring borne by the second portion of the removable lid, and which biasingly cooperates with the latch so as to cause the latch to be urged in a radially outward direction relative to the second portion of the removable lid, and wherein the latch is reciprocally moveable along a path of travel which is perpendicular relative to the longitudinal axis of the container body.

6. A fluid dispensing vessel as claimed in claim 5, and wherein the latch has an intermediate portion which is located between the first and second ends thereof, and which defines, at least in part, an aperture, and wherein the first biasing spring extends through the aperture defined by the intermediate portion of the latch, and wherein a first biasing force generated by the first biasing spring is substantially perpendicular to a second biasing force which is generated by the second biasing spring.

7. A fluid dispensing vessel as claimed in claim 6, and wherein a physical force applied by a user to the first end of the latch overcomes the second biasing force of the second biasing spring, and thereafter causes the engagement portion of the latch to move out of engagement with the first portion of the removable lid, and wherein following disengagement of the engagement portion from the first portion of the removable lid, the first biasing spring moves the second portion of the removable lid from the first position to the second position.

8. A fluid dispensing vessel as claimed in claim 7, and wherein a force applied by a user in a direction along the longitudinal axis of the container body, and in a direction toward the container body overcomes the first biasing force generated by the first biasing spring, and wherein in response to this aforementioned inwardly directed longitudinal force, the second portion of the removable lid moves from the second position to the first position, and wherein, in the first position, the second biasing spring causes the engagement portion of the latch to move into cooperative engagement with the first portion of the removable lid so as to releasably secure the second portion of the removable lid in the first position.

9. A fluid dispensing vessel, comprising:

a container body defining an internal cavity for enclosing a source of a fluid to be dispensed, and a top dispensing opening through which the source of fluid passes to be received in, and pass out of the internal cavity;

a first portion which receives, in part, and sealably cooperates with, the container body, and which further defines a first passageway, having a valve seat, and which allows the source of fluid to flow out of the internal cavity of the container body;

a second portion which telescopingly receives and reciprocally cooperates, at least in part, with the first portion, and wherein the second portion further includes a valve member for selectively sealably occluding the first passageway, by engaging the valve seat of the first passageway, when the removable lid is located in the first position, and which further allows fluid to flow out of a container body when the removable lid is located in the second position;

a first fluid impervious seal borne by the valve member for sealably engaging the valve seat, and effectively occluding the first passageway when the removable lid is in the first position;

a second fluid impervious seal borne by the first passageway as defined by the first portion of the removable lid, and which sealably engages the second portion of the removable lid when the removable lid is in each of the first and second positions;

a removable lid for selectively occluding the top dispensing opening of the container body, and wherein the removable lid defines, at least in part, a fluid dispensing opening, and wherein the removable lid is moveable along a predetermined path of travel between a first position, which prohibits fluid flow from the internal cavity of the container body, and a second position, which permits fluid flow from the container body; and a spring biased latch which is moveably borne by the removable lid, and which further retains the removable lid in the first position, and which, when forcibly engaged, permits the removable lid to move from the first position, to the second position.

10. A fluid dispensing vessel as claimed in claim 9, and wherein a portion of the container body defining the top dispensing opening is telescopingly received within the removable lid in the nature of friction fit.

11. A fluid dispensing vessel as claimed in claim 9, and wherein a portion of the container body defining the top dispensing opening mechanically cooperates with the removable lid.

12. A fluid dispensing vessel as claimed in claim 11, and further comprising:

a first biasing spring positioned between the first and second portions of the removable lid, and wherein the first biasing spring causes the removable lid to move from the first position to the second position.

13. A fluid dispensing vessel as claimed in claim 12, and wherein the spring biased latch is moveably borne by the second portion of the removable lid, and further selectively engages the first portion of the removable lid when the removable lid is in the first position, and wherein the spring biased latch includes a second biasing spring which causes the latch to biasingly engage the first portion of the removable lid, and wherein the latch when forcibly engaged by a user compresses the second biasing spring so as to permit the latch to disengage from the first portion of the removable lid and facilitates a movement of the removable lid from the first position to the second position.

14. A fluid dispensing vessel as claimed in claim 13, and wherein the spring biased latch includes a first end which extends substantially radially outwardly relative to the second portion of the removable lid, and which further when forcibly engaged causes the latch to disengage from the first portion of the removable lid, and the second portion of the removable lid to move from the first to the second position.

15. A fluid dispensing valve as claimed in claim 13, and wherein the removable lid moves from the second position back to the first position when a longitudinally inwardly directed force is applied to the removable lid which is sufficient to overcome a biasing force which is provided by the first biasing spring, and which further simultaneously causes the second portion of the removable lid to move from the second position to the first position, and wherein in the first position the spring biased latch can engage the first portion of the removable lid so as to maintain the removable lid in the first position.

16. A fluid dispensing valve as claimed in claim 13, and wherein the first and second biasing springs apply individual forces which are perpendicularly oriented one relative to the other.

17. A fluid dispensing vessel, comprising:

a container body defined by a sidewall, a bottom surface coupled to the sidewall, and which further has a longitudinal axis, and wherein the container body has a top peripheral edge defining a dispensing opening, and wherein the sidewall of the container body further defines an internal cavity for enclosing a source of liquid to be dispensed to a user;

a first portion of a removable lid which releasably engages the sidewall of the container body, and which further at least partially occludes the dispensing opening thereof, and wherein the first portion has a main body having a longitudinal axis which is further defined, at least in part, by a top surface which has a peripheral edge, and wherein a continuous sidewall having inwardly and outwardly facing surfaces depends downwardly from the peripheral edge, and wherein the inwardly facing surface of the continuous sidewall further defines an internal cavity which is sized so as to telescopingly receive, at least in part, and sealably cooperates, with the top peripheral edge of the container body, and wherein the outside facing surface of the continuous sidewall defines a recessed channel having a given length dimension, and which has a proximal and a distal end, and wherein the top surface of the first portion of the removable lid further has a first spring seat which is defined by a continuous sidewall forming a cavity, and wherein the continuous sidewall of the first spring seat extends normally upwardly relative to the top surface of the first portion, and wherein the continuous sidewall of the first spring seat has a first engagement aperture formed therein, and which extends therethrough, and wherein the top surface further has a first passageway which extends normally, upwardly, relative thereto, and wherein the first passageway is defined by a continuous sidewall which has a proximal end mounted on the top surface of the first portion, and an opposite, distal end, and wherein the sidewall defining the first passageway is coaxially oriented relative to a valve seat which is formed in the top surface of the first portion, and wherein the valve seat couples the first passageway in fluid flowing relation relative to internal cavity of the container body;

a second portion of the removable lid which is reciprocally longitudinally moveable relative to both the first portion of the removable lid, and the container body, and wherein the second portion of the removable lid has a main body defined by a top surface, and which has inwardly and outwardly facing surfaces, and a peripheral edge, and wherein a circumscribing sidewall extends downwardly relative to the peripheral edge of the main body, and which also has inwardly and outwardly facing surfaces, and wherein the top surface of the second portion defines a fluid dispensing aperture which extends therethrough, and which is oriented in fluid flowing communication with the distal end of the first passageway as defined by the first portion of the removable lid, and wherein the inside facing surface of the circumscribing sidewall of the second portion defines an internal cavity which is sized so as to telescopingly receive the first portion of the removable lid, and to facilitate, at least in part, the reciprocal longitudinal movement of the second portion relative to the first portion, and wherein the inside facing surface of the continuous sidewall of the second portion further includes a protrusion which is matingly received within the recessed channel defined by the first portion, and which is operable to limit the reciprocal longitudinal movement of the second portion relative to the first portion, and wherein a latch aperture is formed in the continuous sidewall of the second portion, and wherein a valve member is mounted on the inside facing surface of the top surface of the second portion, and is coaxially aligned relative to the first passageway as defined by the first portion of the removable lid, and wherein the valve member has a distal end which sealably mates with the valve seat as defined by the first portion when the second portion of the removable lid is located in a first position, so as to prohibit a flow of the source of the liquid from the container body, and is displaced from the valve seat when the second portion of the removable lid is located in a second position, so as to facilitate the flow of the source of the liquid from the container body, through the first passageway, and out of the fluid dispensing aperture formed in the top surface of the second portion, and wherein a second spring seat is defined by a continuous sidewall which depends downwardly relative to the inside facing surface of top surface of the second portion, and wherein the continuous sidewall of the second spring seat has inside and outside facing surfaces, and wherein the inside facing surface thereof defines a cavity which is coaxially aligned relative to the first spring seat and is sized so that the first spring seat may be telescopingly received within the cavity as defined by the second spring seat, and wherein the continuous sidewall defining the second spring seat has a second engagement aperture formed therein, and wherein when the second portion of the removable lid is in the first position, the first and second engagement apertures are coaxially aligned, and wherein the outside facing surface of the continuous sidewall forming the second spring seat has a latch guiding channel formed therein;

a first biasing spring positioned between the first and second portions of the removable lid and located in the cavities defined by the first and second spring seats, and wherein the first biasing spring exerts a first biasing force which causes the second portion of the removable lid to be urged in a direction towards the second position, which is coaxially oriented relative to the longitudinal axis of the container body;

a moveable latch borne by the second portion of the removable lid, and which releasably secures the second portion of the removable lid in the first position against the first biasing force as exerted by the first biasing spring, and wherein the latch has a main body with a first, proximal end, which extends radially outwardly relative to the second portion of the removable lid, and out through the latch aperture formed in second portion; a second, distal end, which mounts an inwardly facing engagement portion which is slideably received within, and extends through, the second engagement aperture as defined by the second spring seat; and an intermediate portion which extends between the first and second ends, and wherein the intermediate portion of the latch defines an aperture which is sized so as to receive the second spring seat therein, and wherein the intermediate portion of the latch is slideably received in the latch guiding channel which is formed in the second spring seat; and a second biasing spring is located between the outside facing surface of the continuous sidewall defining the second spring seat, and the first end of the latch, and wherein the second biasing spring is located at least in part within the aperture as defined by the intermediate portion of the main body of the latch, and wherein the second biasing spring exerts a second biasing force which is perpendicular to the first biasing force, and further causes the first end of the latch to be urged radially outwardly relative to the second portion of the removable lid, and wherein when the first portion of the removable lid is located in the first position, the engagement portion of the latch extends through the coaxially aligned first and second engagement apertures as formed in the first and second spring seats so as to retain the second portion in the first position against the first biasing force generated by the first biasing spring, and wherein in the first position, no liquid can be dispensed from the container body, and wherein when a user exerts force on the first end of the latch to move it radially inwardly relative to the second portion of the removable lid, the engagement portion is moved out of the first engagement aperture as defined by the first spring seat, and the first biasing spring is then effective in moving the second portion of the removable lid from the first position to the second position so as to facilitate the dispensing of the source of liquid out through the fluid dispensing opening as formed in the second portion of the removable lid.

* * * * *